US006231210B1

(12) United States Patent
Pendergrass

(10) Patent No.: US 6,231,210 B1
(45) Date of Patent: May 15, 2001

(54) FIXED FRAME CONFIGURED STRING SET

(75) Inventor: Edward A. Pendergrass, Mentor, OH (US)

(73) Assignee: General Electric Compan, Schnectady, NY (US)

( * ) Notice: Subject to any disclaimer, the term of this patent is extended or adjusted under 35 U.S.C. 154(b) by 0 days.

(21) Appl. No.: 09/461,971

(22) Filed: Dec. 15, 1999

(51) Int. Cl.[7] ..... F21V 21/00

(52) U.S. Cl. ..... 362/249; 362/125; 362/145; 362/806; 362/152

(58) Field of Search ..... 362/249, 382, 362/152, 145, 125, 806, 250, 252; 439/505, 174, 488 R, 491

(56) References Cited

U.S. PATENT DOCUMENTS 3,275,818 * 9/1966 Campbell ..... 362/249
4,821,158 * 4/1989 Mitten ..... 362/249
5,513,081 * 4/1996 Byers ..... 362/145
5,954,419 * 9/1999 D'Angelo ..... 362/152

* cited by examiner

*Primary Examiner*—Sandra O'Shea
*Assistant Examiner*—David V. Hobden
(74) *Attorney, Agent, or Firm*—Fay, Sharpe, Fagan, Minnich & McKee, LLP

(57) ABSTRACT

A string light assembly is dimensioned for receipt on a standard structural frame such as a door, window, garage, etc. The lamps are spaced along an intermediate portion of the light string and a male plug is provided at a first end and a female receptacle at the other end. The light string further includes corner markings for identifying installation locations of the string set on the associated structural frame. It is also contemplated that a rigid framing member could receive a portion of the string light assembly to provide precise alignment and prevent sagging.

8 Claims, 2 Drawing Sheets

FIXED FRAME CONFIGURED STRING SET

BACKGROUND OF THE INVENTION

1. Field of the Invention

This application relates to string lights which are typically a strand of lamps having a female electrical plug at one end and a connector or male plug at the other. More particularly, the invention relates to string sets for both internal and external use, particularly about fixed frame structures such as doors, windows, and the like.

2. Discussion of the Art

Holiday lighting of commercial and residential structures is a rapidly developing business. Conventionally, holiday decorations were limited to the Christmas season; however, there has been an increased use of decorative lighting not only with this popular season but also with other holidays, such as Halloween, or even for year-round decoration.

It is common to secure string sets along fences, walls, bushes, hedges, trees, gutters, etc. However, there has been no attempt to tailor the string sets to fixed frame structures. The term "fixed frame structure" includes doors, windows, garage door frames, etc. which have a relatively standardized set of frame dimensions. For example, single outside doors come in three basic widths, thirty four inches (34"), thirty six inches (36") and forty inches (40"). The length or height is approximately eighty two inches (82"). Likewise, double doors and windows and garages have relatively standard sizes.

Commercially available string sets, on the other hand, are available in various lengths. The length is determined by the number of lamps or lights provided an the string set. For example, commercially available string sets are available with fifty (50), seventy (70) and one hundred lights (100). These lengths may vary from one manufacturer to the next, but generally have their own predetermined length that has no relationship to the fixed frame structures noted above.

Consequently, when a consumer installs the light sets on standard frame structures, extended lengths or overlaps of lights result. Accordingly, a need exists to provide a string set having a predetermined length that coincides with the standardized frame structures.

BRIEF SUMMARY OF THE INVENTION

A new and improved string light assembly is provided for use with standard structural frames such as doors, windows, and garages.

In an exemplary embodiment of the invention, the string light assembly includes a male member or plug at a first end for connecting the string light assembly to an associated source of energy. A female member or receptacle is provided at a second end for connecting the assembly to an adjacent string set. Lamps are spaced along the string set between the first and second ends and at least one corner marking is provided on the string set for informing the user of installation locations of the string set on an associated structural frame.

In another exemplary embodiment of the invention, a rigid framing member may be associated with a portion of the string light assembly.

A principal advantage of the invention resides in the enhanced ease of decorating standard sized structural frames.

Another advantage of the invention resides in the exact fit between the light set and the structural frame.

DETAILED DESCRIPTION OF THE INVENTION

Figure 1:
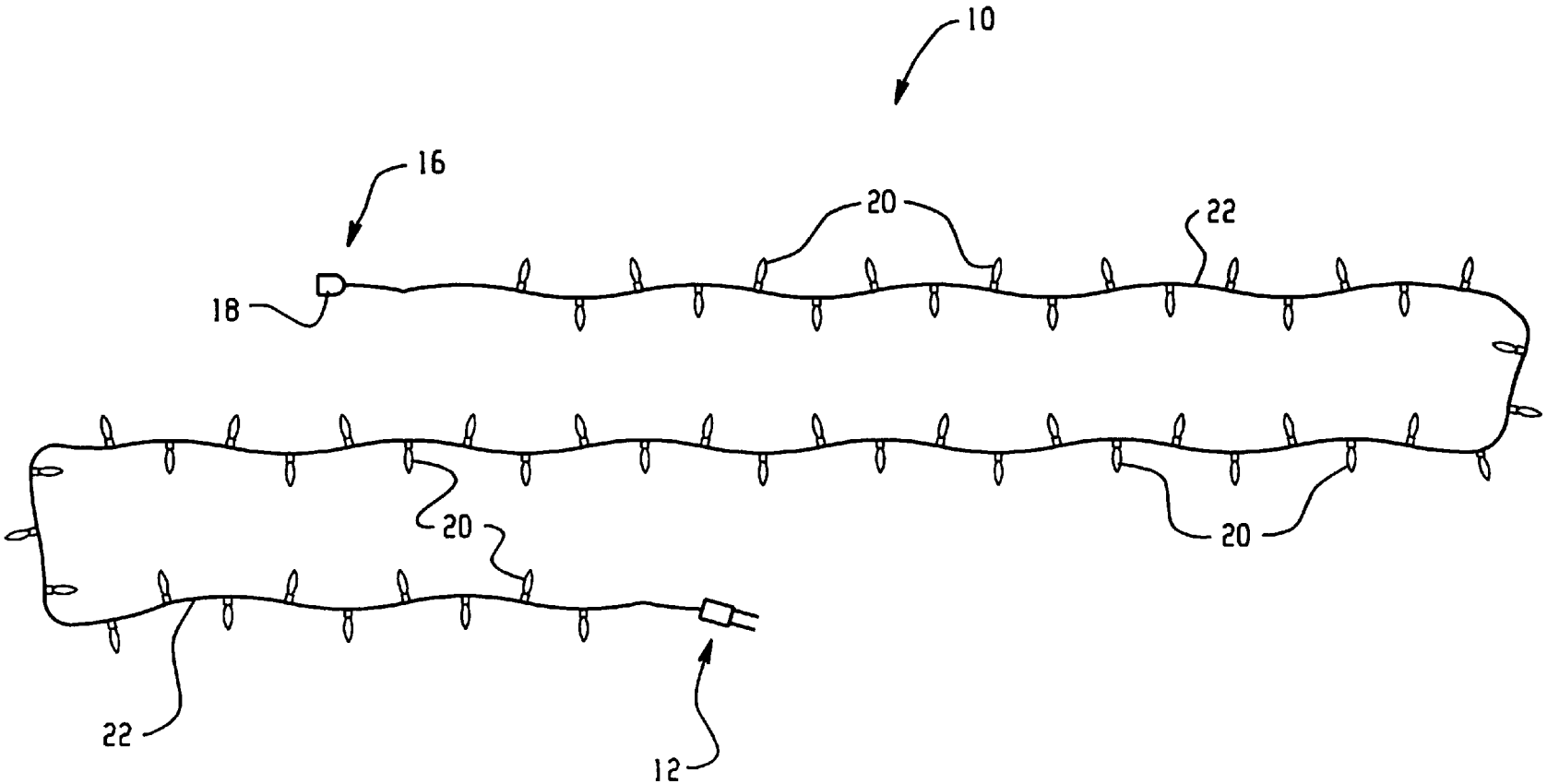
FIG. 1 illustrates a string light assembly in accordance with the present invention.

A string light assembly 10 includes a first end 12 having an electrical connector member such as a male plug adapted for receipt in an electrical outlet, extension cord or adjacent string set to provide electrical energy to the light assembly. A second end 16 includes an electrical connector, preferable a female receptacle 18. Again, the female receptacle is adapted for connection to an adjacent string set or forms the terminal end of the string light assembly.

Preferably spaced inwardly from the first and second ends are a series of lights or lamps 20. The lamps are spaced apart along the length of the string light assembly and may be connected together serially or in parallel, as is known in the art. The electrical wire 22 interconnecting the lamps defines the string of the string light assembly and is typically flexible enough to adapt the assembly to the contours of various structures such as fences, walls, bushes, trees, fixed frame structures, etc. Individual clips (not shown) may also be provided along the length of the light assembly to aid in securing the light string to the associated structure.

Conventionally, the string light sets were available with different numbers of lamps. Thus, the overall length of the string light assembly is dictated by the number of lights and the light spacing. That is, generally speaking, the greater the number of lamps, the greater the length. The overall length of the assembly, however, had no relation to the structure on which it was mounted. For this reason, string light assemblies would be bunched together or doubled up, or stretched to cover different lengths in an effort to meet the dimensional constraints of the underlying structure. The present invention, on the other hand, considers the dimensions of standard door frames, window frames, garage doors, etc., i.e., the underlying structural frame, and provides a light string linear dimension that meets the standard structural frame. For example as described above, outside doors come in three widths of thirty four inches (34"), thirty six inches (36"), and forty inches (40"). The height is approximately eighty two inches (82") so that the overall linear length is approximately one hundred ninety eight inches when a few inches (three inches) are subtracted from each end to keep the light string off the ground and/or out of the snow (79"+40"+79"=182"). This is illustrated by the three dimensions referenced by numerals 30, 32, 34. By spacing the lights a predetermined dimension from each end, a sufficient length is provided for the electrical connections at the ends of the string set assembly to reach an extension cord, electrical outlet, etc. At the same time, the first lamp at each end will be spaced from the end of the string set assembly to accommodate a light snowfall.

In addition, the corner marker or marking 40 is provided on the light string to assist the user in mounting the string light assembly to the frame. A pair of corner markings 40 is shown, such as a tag or different colored portion of the light string, etc. In the example shown, the corner markers are approximately forty inches (40") apart and approximately eighty inches (80") from each end. This allows a user to quickly and easily establish the mounting location of the string light assembly.

Figure 3:
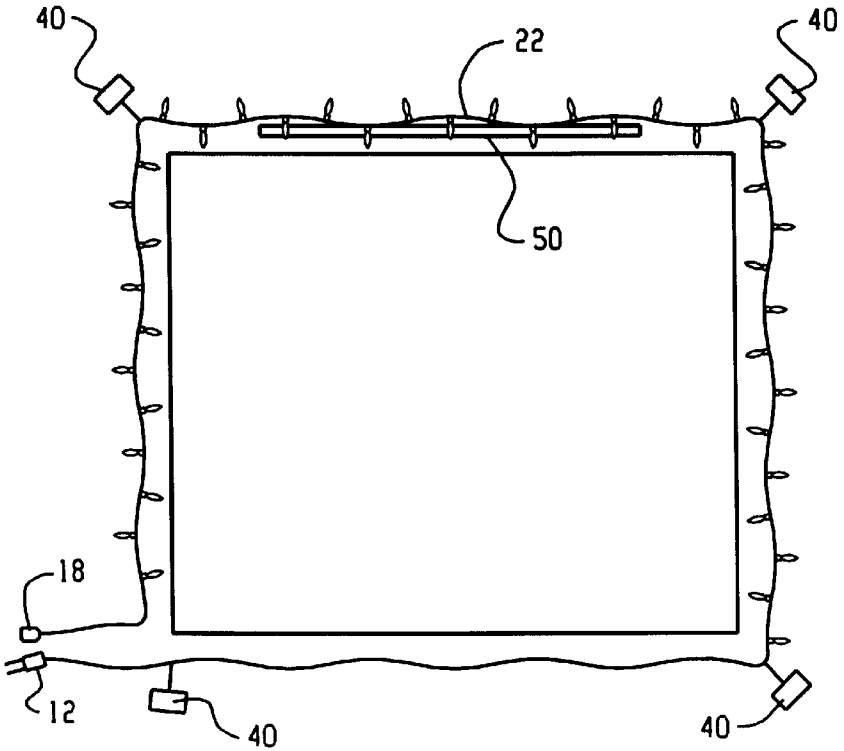
FIG. 3 illustrates a string light set mounted about a standard sized window.
Figure 2:
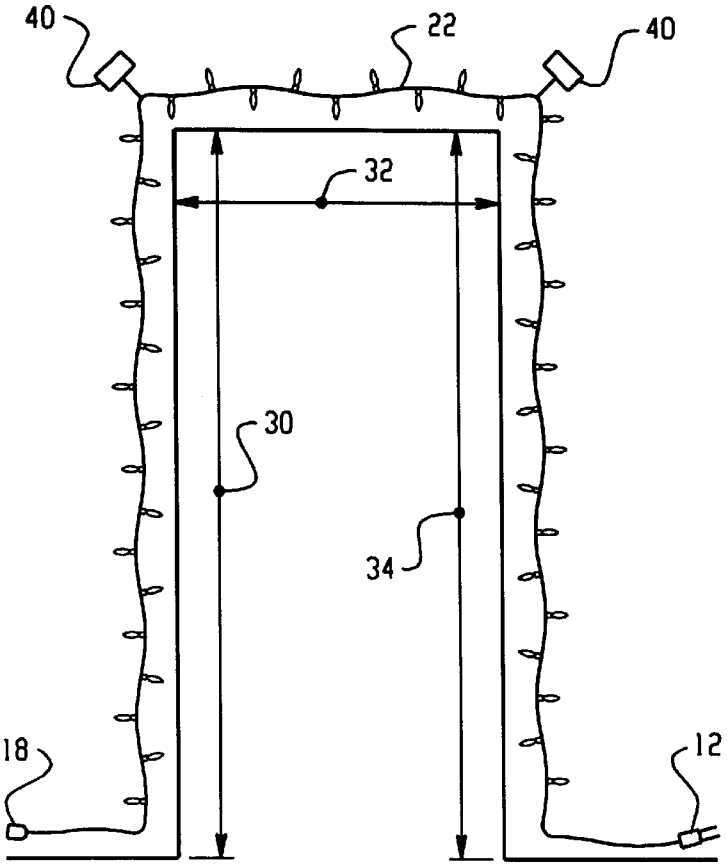
FIG. 2 illustrates the application of the string light assembly to a standard doorway.

As shown in FIG. 3, a window frame follows the same general features as described above with respect to the door frame. The light string for the window frame includes third and fourth corner markings to assist in placement of the string set around the window. Again, the first and second ends of the light set have a sufficient lead without any lamps so that connection to extension cords or outlets is available.

As also illustrated, it may be desired to have a generally rigid support member 50 that extends along a portion of the length of the string light assembly. For example, to provide support from sagging along the horizontal extent of the door frame or window frame, the rigid member is dimensioned to allow the light assembly to be wrapped around it, or received in a clear tube, etc. This provides desired alignment as well as ease of assembly, without adverse effect on the operation of the light string assembly.

The invention has been described with respect to the preferred embodiments. Obviously, modifications and alterations will occur to others upon a reading and understanding of this specification. It intended to include all such modifications and alterations insofar as they come within the scope of the appended claims or the equivalents thereof

What is claimed is:

1. A string light assembly for receipt on a standard structural frame comprising:

a male member at a first end for connecting the assembly to an associated source of energy;

a female member at a second end for connecting the assembly to an adjacent string set;

a plurality of lamps spaced along the string set between the first and second ends; and a corner marking on the string set for identifying an installation location of the string set on an associated structural frame.

2. The string light assembly of claim 1 further comprising a second corner marking on the string set for identifying an installation location on an associated surface.

3. The string light assembly of claim 2 wherein the first and second corner markings are generally equally spaced from the first and second ends, respectively.

4. The string light assembly of claim 1 further comprising a generally rigid framing member that operatively receives a portion of the string light assembly.

5. A string light assembly for receipt on a standard structural frame comprising:

a male plug at a first end for connecting the assembly to one of an associated source of energy and an adjacent string light assembly;

a female receptacle at a second end for connecting the assembly to an adjacent string set;

a plurality of lamps spaced along the string set between the first and second ends; and first and second corner markings on the string set for identifying installation locations of the string set on an associated structural frame.

6. The string light assembly of claim 5 wherein the lamps are spaced a predetermined dimension inwardly from the male plug and the female receptacle.

7. The string light assembly of claim 6 wherein the first and second corner markings are generally equally spaced from the first and second ends, respectively.

8. The string light assembly of claim 5 further comprising a generally rigid framing member that operatively receives a portion of the string light assembly.

* * * * *